US012503744B2

(12) United States Patent
Perlade et al.

(10) Patent No.: US 12,503,744 B2
(45) Date of Patent: Dec. 23, 2025

(54) HOT ROLLED AND HEAT-TREATED STEEL SHEET AND METHOD OF MANUFACTURING THE SAME

(71) Applicant: ArcelorMittal, Luxembourg (LU)

(72) Inventors: Astrid Perlade, Le Ban-Saint-Martin (FR); Kangying Zhu, Metz (FR); Coralie Jung, Metz (FR); Frédéric Kegel, Yutz (FR)

(73) Assignee: ArcelorMittal, Luxembourg (LU)

( * ) Notice: Subject to any disclaimer, the term of this patent is extended or adjusted under 35 U.S.C. 154(b) by 715 days.

(21) Appl. No.: 17/784,922

(22) PCT Filed: Dec. 17, 2020

(86) PCT No.: PCT/IB2020/062116
§ 371 (c)(1),
(2) Date: Jun. 13, 2022

(87) PCT Pub. No.: WO2021/124203
PCT Pub. Date: Jun. 24, 2021

(65) Prior Publication Data

US 2023/0032122 A1 Feb. 2, 2023

(30) Foreign Application Priority Data

Dec. 19, 2019 (WO) ..... PCT/IB2019/061105

(51) Int. Cl.

| | |
|---|---|
| ***C22C 38/00*** | (2006.01) |
| ***B21B 1/22*** | (2006.01) |
| ***C21D 1/26*** | (2006.01) |
| ***C21D 6/00*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C21D 9/46* (2013.01); *B21B 1/22* (2013.01); *C21D 1/26* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *B21B 2001/225* (2013.01); *C21D 2211/001* (2013.01); *C21D 2211/005* (2013.01); *C21D 2211/008* (2013.01)

(58) Field of Classification Search

CPC . C21D 9/46; C21D 1/26; C21D 6/005; C21D 6/008; C21D 8/0205; C21D 8/0226; C21D 8/0263; C21D 2211/001; C21D 2211/005; C21D 2211/008; C21D 1/18; C21D 2211/002; C21D 2211/004; C21D 8/0247; B21B 1/22; B21B 2001/225; C22C 38/001; C22C 38/002; C22C 38/02; C22C 38/04; C22C 38/06; C22C 38/12; C22C 38/14

See application file for complete search history.

(56) References Cited

U.S. PATENT DOCUMENTS

| | | | | |
|---|---|---|---|---|
| 2005/0199322 | A1 | 9/2005 | Nakamura et al. | |
| 2009/0107588 | A1 | 4/2009 | Sebastien et al. | |
| 2013/0319582 | A1 | 12/2013 | Yokoi et al. | |
| 2014/0050941 | A1 | 2/2014 | Kawasaki et al. | |
| 2014/0299237 | A1 | 10/2014 | Somani et al. | |
| 2015/0329950 | A1 | 11/2015 | Azuma et al. | |
| 2017/0204491 | A1 | 7/2017 | Kawasaki et al. | |
| 2018/0371566 | A1 | 12/2018 | Gospodinova | |
| 2019/0003005 | A1 | 1/2019 | Jun et al. | |
| 2019/0330721 | A1 | 10/2019 | Hayashi et al. | |
| 2020/0149129 | A1* | 5/2020 | Beauvais | C21D 1/19 |
| 2020/0190612 | A1* | 6/2020 | Kwak | C21D 8/0236 |

(Continued)

FOREIGN PATENT DOCUMENTS

| | | | |
|---|---|---|---|
| CN | 107002155 | A | 8/2017 |
| CN | 108431241 | A | 8/2018 |

(Continued)

OTHER PUBLICATIONS

Search Report of PCT/IB2020/062004 dated Jan. 2, 2021.

(Continued)

*Primary Examiner* — Rebecca Janssen
(74) *Attorney, Agent, or Firm* — Davidson Kappel LLC

(57) ABSTRACT

A hot rolled and heat-treated steel sheet having a composition including, by weight percent C 0.12-0.25% Mn 3.0-8.0%, Si 0.70-1.50%, Al 0.3-1.2%, B 0.0002-0.004%, S≤0.010%, P≤0.020%, N≤0.008%, the remainder of the composition being iron and unavoidable impurities resulting from the smelting, and having a microstructure consisting of, in surface fraction: between 5% and 45% of ferrite, between 25% and 85% of partitioned martensite, the partitioned martensite having a carbides density less than $2\times10^6$ /mm$^2$, between 10% and 30% of retained austenite, less than 8% of fresh martensite, a part of the fresh martensite being combined with retained austenite in the shape of martensite-austenite islands in total surface fraction less than 10%, and a pancaking index lower than 5.

12 Claims, No Drawings

(56) References Cited

U.S. PATENT DOCUMENTS

| | | | |
|---|---|---|---|
| 2020/0270713 | A1 | 8/2020 | Gospodinova et al. |
| 2022/0282348 | A1 | 9/2022 | Arlazarov et al. |
| 2023/0002847 | A1* | 1/2023 | Perlade ..... C22C 38/14 |

FOREIGN PATENT DOCUMENTS

| | | | |
|---|---|---|---|
| CN | 108513591 | A | 9/2018 |
| CN | 109554622 | A | 4/2019 |
| CN | 109715843 | A | 5/2019 |
| CN | 110055465 | A | 7/2019 |
| EP | 2631307 | A1 | 8/2013 |
| EP | 2698440 | A1 | 2/2014 |
| EP | 2752500 | A1 | 7/2014 |
| EP | 3112488 | A1 | 1/2017 |
| EP | 3550047 | A1 | 10/2019 |
| JP | 2005290547 | A | 10/2005 |
| JP | 2012237054 | A | 12/2012 |
| WO | WO2007101921 | | 9/2007 |
| WO | WO 2016001703 | A1 | 1/2016 |
| WO | WO2016021196 | A1 | 2/2016 |
| WO | WO 2016/187576 | A1 | 11/2016 |
| WO | WO 2018/055425 | A1 | 3/2018 |
| WO | WO 2018/162937 | | 9/2018 |
| WO | WO 2018220430 | A1 | 12/2018 |
| WO | WO2019/111029 | A1 | 6/2019 |
| WO | WO 2019/123240 | A2 | 6/2019 |
| WO | WO 2019/123245 | A1 | 6/2019 |
| WO | WO 2021/124132 | A1 | 6/2021 |
| WO | WO 2021/124199 | A1 | 6/2021 |
| WO | WO 2021/124203 | A1 | 6/2021 |
| WO | WO2021124136 | A1 | 6/2021 |

OTHER PUBLICATIONS

Written Opinion of PCT/IB2020/062004.
Search Report of PCT/IB2019/062111 dated Feb. 17, 2021.
Written Opinion of PCT/IB2020/062111.
Search Report of PCT/IB2019/062011 dated Sep. 2, 2021.
Written Opinion of PCT/IB2020/062011.
Search Report of PCT/IB2020/062116 dated Feb. 22, 2021.
Written Opinion of PCT/IB2020/062116.
Cooman De B C et al, "Quench and Partitioning Steel: A New AHSS Concept for Automotive Anti-Intrusion Applications", Steel Research International, Verlag Stahleisen Gmbh., Dusseldorf, DE, (Sep. 1, 2006), vol. 77, No. 9/10, ISSN 1611-3683, pp. 634-640.

* cited by examiner

HOT ROLLED AND HEAT-TREATED STEEL SHEET AND METHOD OF MANUFACTURING THE SAME

The present invention relates to a hot rolled and heat-treated high strength steel sheet having high ductility and to a method to obtain such steel sheet.

BACKGROUND

To manufacture various items such as parts of body structural members and body panels for automotive vehicles, it is known to use sheets made of DP (Dual Phase) steels or TRIP (Transformation Induced Plasticity) steels.

One of the major challenges in the automotive industry is to decrease the weight of vehicles in order to improve their fuel efficiency in view of global environmental conservation, without neglecting safety requirements. To meet these requirements, new high strength steels are continuously developed by the steelmaking industry, to have sheets with improved yield and tensile strengths, and good ductility and formability.

SUMMARY OF THE INVENTION

The publication WO2019123245 describes a method to obtain a high strength and high formability cold rolled steel sheet with a yield strength YS comprised between 1000 MPa and 1300 MPa, a tensile strength TS comprised between 1200 MPa and 1600 MPa, a uniform elongation UE of at least 10%, a hole expansion ratio HER of at least 20%, thanks to a quenching & partitioning process. The microstructure of the cold rolled steel sheet consists of, in surface fraction: between 10% and 45% of ferrite, having an average grain size of at most 1.3 μm, the product of the surface fraction of ferrite by the average grain size of the ferrite being of at most 35 μm %, between 8% and 30% of retained austenite, said retained austenite having an Mn content higher than 1.1*Mn %, Mn % designating the Mn content of the steel, at most 8% of fresh martensite, at most 2.5% of cementite and partitioned martensite. To attain such mechanical properties and to obtain this microstructure, the hot rolled steel sheet has to be annealed a first time, cold rolled, and annealed a second time before the quenching and the partitioning steps. Those processes, and in particular the second annealing, allow to control the Mn content in the retained austenite, to obtain a combination of high ductility and high strength, but complicates the manufacturing process.

It is an object of the present invention to provide a hot rolled steel sheet having yield strength YS higher than 950 MPa, tensile strength TS higher than 1180 MPa, a uniform elongation UE higher than 10% and a hole expansion ratio HER higher than 25% and easily processable on a conventional process route.

The present invention provides a hot rolled and heat-treated steel sheet, made of a steel having a composition comprising, by weight percent:

C: 0.12-0.25%
Mn: 3.0-8.0%
Si: 0.7-1.5%
Al: 0.3-1.2%
B: 0.0002-0.004%
S≤0.010%
P≤0.020%
N≤0.008% and comprising optionally one or more of the following elements, in weight percentage:

Mo≤0.5%
V≤0.2%
Nb≤0.06%
Ti≤0.05% the remainder of the composition being iron and unavoidable impurities resulting from the smelting, said steel sheet having a microstructure consisting of, in surface fraction:

between 5% and 45% of ferrite,
between 25% and 85% of partitioned martensite, said partitioned martensite having a carbides density less than $2\times10^6$ /mm$^2$,
between 10% and 30% of retained austenite
less than 8% of fresh martensite,
a part of said fresh martensite being combined with retained austenite in the shape of martensite-austenite (M-A) islands in total surface fraction less than 10%,
and a pancaking index lower than 5.

The present invention also provides a method for manufacturing a hot rolled and heat-treated steel sheet, comprising the following successive steps:

casting a steel to obtain a semi-product, said semi product having a composition as described above,
reheating the slab at a temperature $T_{reheat}$ comprised between 1150° C. and 1300° C.,
hot rolling the reheated slab with a finish rolling temperature FRT comprises between Tnr-100° C. and 950° C. to obtain a hot rolled steel sheet, Tnr being the non-recrystallisation temperature defined as $$825+2300*\%\ Nb+710*\%\ Ti+150*\%\ Mo+120*\%\ V+8*\%\ Mn$$

coiling the hot rolled steel sheet at a coiling temperature $T_{coil}$ comprised between 20° C. and 700° C. and cooling to room temperature so to obtain, a microstructure comprising martensite and bainite, the sum of which being greater than 80%, strictly less than 20% of ferrite, and strictly less than 20% of the sum of martensite-austenite (M-A) islands and carbides, and having the multiplication of PAGS in rolling direction by PAGS in normal direction lower than 1000 μm$^2$ and a pancaking index lower than 5,
reheating the hot rolled steel sheet to a temperature TA1 strictly lower than Ae3 and higher than (Ae1+Ae3)/2, and maintaining the steel sheet at said annealing temperature TA1 for a holding time tA1 comprised between 3 s and 1000 s, Ae1 and Ae3 temperature being defined as $$Ae1=670+15*\%\ Si-13*\%\ Mn+18*\%\ Al$$

$$Ae3=890-20*\sqrt{\%}\ C+20*\%\ Si-30*\%\ Mn+130*\%\ Al$$

quenching the hot-rolled steel sheet to a quenching temperature TQ lower than (Ms-50° C.), to obtain a quenched steel sheet, Ms being defined as $$Ms=560-(30*\%\ Mn+13*\%\ Si-15*\%\ Al+12*\%\ Mo)-600*(1-\exp(-0.96*\%\ C))$$

reheating the quenched steel sheet to a partitioning temperature TP comprised between 350° C. and 550° C., and maintaining the quenched steel sheet at said partitioning temperature for a partitioning time comprised between 1 s and 1000 s,
cooling the steel sheet to the room temperature to obtain a hot rolled and heat-treated steel sheet The present invention further provides hot rolled and coiled steel sheet, made of a steel having a composition comprising, by weight percent:

C: 0.12-0.25%
Mn: 3.0-8.0%
Si: 0.7-1.5%
Al: 0.3-1.2%
B: 0.0002-0.004%
S≤0.010%
P≤0.020%
N≤0.008% and comprising optionally one or more of the following elements, in weight percentage:

Mo≤0.5%
V≤0.2%
Nb≤0.06%
Ti≤0.05% the remainder of the composition being iron and unavoidable impurities resulting from the smelting, said steel sheet having a microstructure consisting of, in surface fraction:

- martensite and bainite, the sum of which being higher than 80%
- strictly less than 20% of ferrite,
- strictly less than 20% of the sum of martensite-austenite (M-A) islands and carbides,
- and having the multiplication of PAGS in rolling direction $PAGS_{roll}$ by PAGS in normal direction $PAGS_{norm}$ lower than 1000 $\mu m^2$, and the pancaking index lower than 5.

DETAILED DESCRIPTION

The invention will now be described in detail and illustrated by examples without introducing limitations.

Hereinafter, Ae1 designates the equilibrium transformation temperature below which austenite is completely unstable, Ae3 designates the equilibrium transformation temperature above which austenite is completely stable, Ms designates the martensite start temperature, i.e. the temperature at which the austenite begins to transform into martensite upon cooling and Tnr the temperature of non-recrystallization. These temperatures can be calculated from a formula based on the weight percent of the corresponding elements:

$$Ae1=670+15*\%\ Si-13*\%\ Mn+18*\%\ Al$$

$$Ae3=890-20*\sqrt{\%}\ C+20*\%\ Si-30*\%\ Mn+130*\%\ Al$$

$$Ms=560-(30*\%\ Mn+13*\%\ Si-15*\%\ Al+12*\%\ Mo)-600*(1-\exp(-0.96*\%\ C))$$

$$Tnr=825+2300*\%\ Nb+710*\%\ Ti+150*\%\ Mo+120*\%\ V+8*\%\ Mn$$

The composition of the steel according to the invention comprises, by weight percent:

According to the invention, the carbon content is comprised between 0.12% and 0.25%. Above 0.25% of addition, weldability of the steel sheet may be reduced. If the carbon content is lower than 0.12%, the retained austenite fraction is not stabilized enough to obtain a sufficient elongation. In a preferred embodiment, the carbon content is comprised between 0.15% and 0.25%.

According to the invention the manganese content is between 3.0% and 8.0% to obtain sufficient elongation with the stabilization of the austenite. Above 8.0% of addition, the risk of central segregation increases to the detriment of the yield strength and the tensile strength. Below 3.0%, the final structure comprises an insufficient retained austenite fraction, so that the desired combination of ductility and strength is not achieved. In a preferred embodiment, the manganese content is comprised between 3.0% and 4.4%. In another preferred embodiment, the manganese content is comprised from 3.0% to 4.3%. In another preferred embodiment, the manganese content is comprised from 3.0% to 4.2%. In another preferred embodiment, the manganese content is comprised from 3.0% to 4.1%. In an other preferred embodiment, the manganese content is comprised from 3.0% to 4.0%.

The silicon content according to the invention is comprised between 0.7% and 1.5%. A silicon addition of at least 0.7% helps to stabilize a sufficient amount of retained austenite. Above 1.5%, silicon oxides form at the surface, which impairs the coatability of the steel. In a preferred embodiment, the silicon content is comprised between 0.8% and 1.3%.

The aluminium content is comprised between 0.3% and 1.2%. Aluminium is a very effective element for deoxidizing the steel in the liquid phase during elaboration. The aluminium content is not higher than 1.2% to avoid the occurrence of inclusions and to avoid oxidation problems. In a preferred embodiment, the aluminium content is comprised between 0.3% and 0.8%.

According to the invention, the boron content is comprised between 0.0002% and 0.004% to increase the quenchability of the steel and to improve the weldability.

Optionally some elements can be added to the composition of the steel according to the invention:

Niobium can be optionally added up to 0.06% to refine the austenite grains during hot-rolling and to provide precipitation strengthening. Preferably, the minimum amount of niobium added is 0.0010%. Above 0.06%, yield strength and elongation are not secured at the desired level.

Molybdenum can be optionally added up to 0.5%. Molybdenum stabilizes the retained austenite thus reducing austenite decomposition during partitioning. Above 0.5%, the addition of molybdenum is costly and ineffective in view of the properties which are required.

Vanadium can be added up to 0.2% in order to provide precipitation strengthening.

Titanium can be added up to 0.05% to provide precipitation strengthening. If the titanium level is above or equal to 0.05%, yield strength and elongation are not secured at the desired level. Preferably a minimum of 0.01% of titanium is added in addition of boron to protect boron against the formation of BN.

The remainder of the composition of the steel is iron and impurities resulting from the smelting. In this respect, P, S and N at least are considered as residual elements which are unavoidable impurities. Their content is less than 0.010% for S, less than 0.020% for P and less than 0.008% for N.

The microstructure of the hot rolled and heat-treated steel sheet according to the invention will now be described.

The hot rolled and heat-treated steel sheet has a microstructure consisting of, in surface fraction, between 5% and 45% of ferrite, between 25% and 85% of partitioned martensite, said partitioned martensite having a carbides density less than $2\times10^6$ /mm$^2$, between 10% and 30% of retained austenite, less than 8% of fresh martensite, a part of fresh martensite being combined with retained austenite to form martensite-austenite (M-A) islands in total surface fraction of less than 10%, and a pancaking index lower than 5.

The microstructure of the hot-rolled and heat-treated steel sheet comprises between 5% and 45% ferrite. This ferrite is formed during the annealing between (Ae1+Ae3)/2 and Ae3.

Below 5% of ferrite fraction, the uniform elongation does not reach 10%. If the ferrite fraction is higher than 45%, the tensile strength of 1180 MPa and the yield strength of 950 MPa are not achieved. Preferably, the microstructure comprises 10% or more of ferrite. More preferably, the microstructure comprises 15% or more of ferrite.

The microstructure of the hot-rolled and heat-treated steel sheet comprises between 25% and 85% of partitioned martensite, to ensure high ductility of the steel. Partitioned martensite is the martensite formed upon cooling after the annealing then partitioned during the partitioning step. Said partitioned martensite has a carbides density less than $2\times10^6$ /mm$^2$. The low density of carbides inside partitioned martensite ensures a combination of good level of tensile strength and elongation.

The microstructure of the hot-rolled and heat-treated steel sheet comprises between 10% and 30% of retained austenite, to ensure high ductility of the steel and less than 8% of fresh martensite. Fresh martensite is formed during the cooling to room temperature of the hot rolled and heat-treated steel sheet.

A part of fresh martensite is combined with retained austenite to form martensite-austenite (M-A) islands, in total surface fraction less than 10%. In a preferred embodiment, these M-A islands has an aspect ratio lower or equal to 2, the aspect ratio being defined as the ratio of the maximum length of a grain to the maximum width of the grain measured at 90° of said maximum length.

The microstructure of the hot-rolled and heat-treated steel sheet has pancaking index lower than 5. The pancaking index is defined as the ratio of the prior austenite grain size in the rolling direction $PAGS_{roll}$ over the prior austenite grain size in the normal direction $PAGS_{norm}$. $PAGS_{roll}$ is the maximum length of prior austenite grain in rolling direction. $PAGS_{norm}$ is the maximum length of prior austenite grain in normal direction. When pancaking index is higher than 5, the hole expansion ratio cannot be at the target.

The steel sheet according to the invention can be produced by any appropriate manufacturing method and the person skilled in the art can define one. It is however preferred to use the method according to the invention comprising the following steps:

A semi-finished product able to be further hot-rolled, is provided with the steel composition described above. The semi-finished product is heated to a temperature $T_{reheat}$ comprised between 1150° C. and 1300° C., so to make it possible to ease hot rolling, with a final hot rolling temperature FRT comprises between Tnr-100° C. and 950° C., to obtain a hot rolled steel sheet. The maximum value of FRT is chosen in order to avoid coarsening of the austenitic grains and so that the multiplication of $PAGS_{roll}$ by $PAGS_{norm}$ is lower than 1000 μm$^2$. When the multiplication of $PAGS_{roll}$ by $PAGS_{norm}$ is higher than 1000 μm$^2$, the strength cannot be at the target.

FRT is higher than Tnr-100° C. to generate a microstructure with a prior austenite grain pancaking index lower than 5, the pancaking index being defined as the ratio of the $PAGS_{roll}$ over $PAGS_{norm}$. When pancaking index is higher than 5, the hole expansion ratio cannot be at the target.

The hot-rolled steel is then cooled and coiled at a temperature $T_{coil}$ comprised between 20° C. and 700° C. Preferably, the coiling temperature is comprised from 20° C. to 550° C.

After the coiling, the sheet can be pickled to remove oxidation.

After the coiling and the cooling to room temperature, the microstructure of the hot rolled and coiled steel sheet comprises martensite and bainite the sum of which being higher than 80%, strictly less than 20% of ferrite and strictly less than 20% of the sum of martensite-austenite (M-A) islands and carbides, and has the multiplication of $PAGS_{roll}$ by $PAGS_{norm}$ lower than 1000 μm$^2$, and the pancaking index lower than 5. Preferably, the microstructure after the coiling and the cooling comprises less than 10% of ferrite, and more preferably no ferrite. Preferably, the microstructure after the coiling and the cooling comprises less than 10% of the sum of M-A islands and carbides.

The martensite of M-A islands is fresh martensite formed during final cooling. The martensite included in the sum of martensite and bainite greater than 80%, is an auto-tempered martensite. The determination of the type of martensite can be done and quantify thanks to a Scanning Electron Microscope.

The hot rolled steel sheet then undergoes a quenching and partitioning process (Q&P). The quenching and partitioning process comprises the steps of:

- reheating the annealed steel sheet to a temperature TA1 strictly lower than Ae3 and higher than (Ae1+Ae3)/2 and maintaining at said annealing temperature TA1 for a holding time tA1 comprised between 3 s and 1000 s, to obtain a heat-treated steel sheet, in order to obtain an austenitic and ferritic structure.
- quenching the heat-treated steel sheet to a quenching temperature TQ lower than (Ms-50° C.), to obtain a quenched steel sheet. During this quenching step, the austenite partly transforms into martensite. If the quenching temperature is higher than (Ms-50° C.), the fraction of tempered martensite in the final structure is too low, leading to a final fresh martensite fraction above 8%, which is detrimental for the total elongation of the steel.
- reheating the quenched steel to a partitioning temperature TP comprised between 350° C. and 550° C. and maintaining at said partitioning temperature for a partitioning time comprised between 1 s and 1000 s before to be cooled to the room temperature, so to obtain a hot-rolled and heat-treated steel sheet.

The hot-rolled and heat treated steel sheet according to the invention has tensile strength TS higher than 1180 MPa, a yield strength YS higher than 950 MPa, a uniform elongation UE higher than 10%, and a hole expansion ratio HER higher than 25%. TS, YS, UE and the total elongation TE are measured according to ISO standard ISO 6892-1. HER is measured according to ISO standard ISO 16630.

In a preferred embodiment, the hot rolled and heat-treated steel sheet according to the invention has TS and YS expressed in MPa, UE, TE and HER, expressed in %, satisfying the following formula: YS*UE+TS*TE+TS*HER>65000. Preferably, the total elongation TE is higher than 14%.

The invention will be now illustrated by the following examples, which are by no way limitative

EXAMPLES 4 grades, whose composition are gathered in table 1, was cast in semi-products and processed into steel sheets following the process parameters gathered in table 2.

The tested composition is gathered in the following table wherein the element contents are expressed in weight percent.

TABLE 1

| Compositions | | | | | | | | | | | | | | | |
|---|---|---|---|---|---|---|---|---|---|---|---|---|---|---|---|
| Steel | C | Mn | Si | Al | Mo | Nb | Ti | B | S | P | N | Ae1 (° C.) | Ae3 (° C.) | Ms (° C.) | Tnr (° C.) |
| A | 0.17 | 3.8 | 1.24 | 0.60 | 0.2 | — | 0.025 | 0.0025 | 0.002 | 0.011 | 0.003 | 650 | 870 | 340 | 903 |
| B | 0.18 | 3.7 | 1.20 | 0.79 | 0.2 | 0.032 | — | 0.0006 | 0.001 | 0.013 | 0.003 | 654 | 897 | 344 | 958 |
| C | 0.19 | 3.9 | 1.17 | 0.39 | 0.2 | 0.02 | 0.029 | 0.0021 | 0.001 | 0.011 | 0.003 | 644 | 838 | 327 | 953 |
| D | 0.18 | 3.8 | 1.19 | 0.47 | 0.3 | — | 0.035 | 0.0005 | 0.002 | 0.011 | 0.004 | 647 | 852 | 335 | 925 |

Steel A-D are according to the invention.

Steel semi-products, as cast, were reheated, hot rolled, and coiled before the quenching and partitioning process. Samples 2 and 5 did undergo an annealing after coiling at a temperature $T_2$ before to be cold rolled with a reduction rate of 50%. The following specific conditions were applied:

TABLE 2

| Process parameters | | | | | | | | | | | | |
|---|---|---|---|---|---|---|---|---|---|---|---|---|
| | | Slab reheating | | Tnr- | | Annealing | | Quenching & Partitioning | | | | |
| Trial | Steel | temperature (° C.) | FRT (° C.) | 100 (° C.) | $T_{Coil}$ (° C.) | $T_2$ (° C.) | time (h) | TA1 (° C.) | tA1(s) | TQ (° C.) | TP (° C.) | t(s) |
| 1* | A | 1200 | 900 | 805 | 450 | — | — | 820 | 230 | 130 | 400 | 250 |
| 2 | B | 1200 | 900 | 858 | 450 | 680 | 5 | 840 | 100 | 140 | 400 | 220 |
| 3* | C | 1250 | 920 | 852 | 20 | — | — | 800 | 230 | 100 | 400 | 250 |
| 4 | C | 1250 | 830 | 852 | 450 | — | — | 800 | 230 | 100 | 400 | 250 |
| 5 | D | 1200 | 900 | 825 | 450 | 630 | 7 | 800 | 220 | 130 | 450 | 220 |

*trials according to the invention.
Underlined values: not corresponding to the invention The annealed sheets were then analyzed and the corresponding microstructure elements before Q&P, after Q&P and mechanical properties after Q&P were respectively gathered in table 3, 4 and 5.

Microstructure of the hot rolled and coiled steel sheets before the Q&P process were determined and gathered in the following table:

TABLE 3

| Microstructure of the steel sheets before the Q&P process | | | | | | | |
|---|---|---|---|---|---|---|---|
| | Microstructure before Q&P | | | | | | |
| Trial | F (%) | B + M(%) | MA + carbides (%) | $PAGS_{roll}$ (μm) | $PAGS_{norm}$ (μm) | $PAGS_{roll}$* $PAGS_{norm}$ ($\mu m^2$) | Pancaking index |
| 1* | 0 | 95 | 5 | 25 | 23 | 575 | 1.1 |
| 2 | 80 | — | 20 | — | — | — | — |
| 3* | 0 | 100 | 0 | 15 | 13 | 195 | 1.2 |
| 4 | 0 | 85 | 15 | 35 | 3.5 | 122.5 | 10 |
| 5 | 97 | — | 3 | — | — | — | — |

*trials according to the invention
Underlined values: not corresponding to the invention
B: stands for bainite surface fraction
F: stands for ferrite surface fraction
M: stands for martensite surface fraction
MA: stands for martensite-austenite islands surface fraction The surface fractions are determined through the following method: a specimen is cut from the hot-rolled and heat-treated, polished and etched with a reagent known per se, to reveal the microstructure. The section is afterwards examined through optical or scanning electron microscope, for example with a Scanning Electron Microscope with a Field Emission Gun ("FEG-SEM") at a magnification greater than 5000×, coupled to a BSE (Back Scattered Electron) device.

The determination of the surface fraction of each constituent are performed with image analysis through a method known per se. The retained austenite fraction is for example determined by X-ray diffraction (XRD).

The PAGS in rolling direction (RD) $PAGS_{roll}$ and in normal direction (ND) $PAGS_{norm}$ are determined through the following method: a specimen is cut from the hot-rolled sheet, polished and etched with a reagent known per se, to reveal the microstructure especially the prior austenite grain boundaries. The section of RD-ND plane is afterwards examined through optical or scanning electron microscope, for example with a Scanning Electron Microscope at a magnification of 1000× to 5000×. The maximum lengths of prior austenite grains in RD and in ND are measured.

Microstructure of the tested samples were determined and gathered in the following table:

TABLE 4

| Microstructure of the steel sheet after the Q&P process | | | | | | | | |
|---|---|---|---|---|---|---|---|---|
| | Microstructure after Q&P | | | | | | | |
| Trial | F(%) | PM (%) | γ (%) | FM (%) | Carbides density in PM ($\times 10^6$/mm2) | MA (%) | FM and MA size (μm) | Pancaking index < 5 |
| 1* | 30 | 48 | 20 | 2 | 1 | 5 | 0.5 | yes |
| 2 | 30 | 42 | 20 | 8 | 1 | 15 | 1.2 | n.a |
| 3* | 20 | 66 | 14 | 0 | 1 | 0 | 0.5 | yes |

TABLE 4-continued

| Microstructure of the steel sheet after the Q&P process | | | | | | | | |
|---|---|---|---|---|---|---|---|---|
| | Microstructure after Q&P | | | | | | | |
| Trial | F(%) | PM (%) | γ (%) | FM (%) | Carbides density in PM ($\times 10^6$/mm2) | MA (%) | FM and MA size (μm) | Pancaking index < 5 |
| 4 | 20 | 65 | 15 | 0 | 1 | 0 | 0.4 | no |
| 5 | 20 | 55 | 20 | 5 | 1 | 15 | 0.8 | n.a |

*trials according to the invention
Underlined values: not corresponding to the invention
n.a: non-assessed valuesy: stands for residual austenite surface fraction
PM: stands for partitioned martensite surface fraction
FM: stands for fresh martensite surface fraction
B: stands for bainite surface fraction
F: stands for ferrite surface fraction
MA: stands for martensite-austenite islands surface fraction Mechanical properties of the tested samples were determined and gathered in the following table:

TABLE 4

| Mechanical properties of quenched and partitioned steel sheet | | | | | | |
|---|---|---|---|---|---|---|
| Trial | YS (MPa) | TS (MPa) | UE (%) | HER (%) | TE (%) | YS*UE + TS*TE + TS*HER |
| 1* | 1049 | 1278 | 11 | 29 | 17 | 70327 |
| 2 | 862 | 1213 | 11 | 23 | 16 | 56789 |
| 3* | 1104 | 1327 | 11 | 34 | 16 | 78494 |
| 4 | 1209 | 1395 | 11 | 17 | 15 | 57939 |
| 5 | 980 | 1364 | 11 | 15 | 13 | 48972 |

*trials according to the invention/Underlined values: not corresponding to the invention The examples 1 and 3 according to the invention show all the targeted properties thanks to their specific composition and microstructures.

In trial 2, the steel sheet is annealed and cold rolled before the Q&P process. The microstructure before Q&P is then 80% ferritic, leading to a high content of fresh martensite after Q&P. This high fraction of large-sized fresh martensite leads to a hole expansion ratio lower than 25%.

In trial 4, the steel sheet is hot rolled with a FRT lower than Tnr-100, leading to pancaking index higher than 5 before and after Q&P. Consequently, the hole expansion ratio is not at the target.

In trial 5, the steel sheet is annealed and cold rolled before the Q&P process. The microstructure before Q&P is then 97% ferritic, leading to a high size fresh martensite after Q&P. This large-sized fresh martensite leads to a hole expansion ratio lower than 25%.

What is claimed is:

1. A hot rolled and heat-treated steel sheet, made of a steel having a composition comprising, by weight percent:

C: 0.12-0.25%
Mn: 3.0-8.0%
Si: 0.7-1.5%
Al: 0.3-1.2%
B: 0.0002-0.004%
S≤0.010%
P≤0.020%
N≤0.008% and optionally one or more of the following elements, in weight percentage:

Mo≤0.5%
V≤0.2%
Nb≤0.06%
Ti≤0.05% a remainder of the composition being iron and unavoidable impurities resulting from processing;

the steel sheet having a microstructure consisting of, in surface fraction: between 5% and 45% of ferrite; between 25% and 85% of partitioned martensite, the partitioned martensite having a carbide density less than $2\times10^6$ /mm$^2$; between 10% and 30% of retained austenite; less than 8% of fresh martensite, a part of said fresh martensite being combined with retained austenite in the shape of martensite-austenite (M-A) islands in total surface fraction less than 10%; and a pancaking index lower than 5.

2. The hot rolled and heat-treated steel sheet as recited in claim 1 wherein the manganese content is comprised between 3.0% and 5.0%.

3. The hot rolled and heat-treated steel sheet as recited in claim 1 wherein the silicon content is comprised between 0.8% and 1.3%.

4. The hot rolled and heat-treated steel sheet as recited in claim 1 wherein the yield strength is higher than 950 MPa.

5. The hot rolled and heat-treated steel sheet as recited in claim 1 wherein the tensile strength is higher than 1180 MPa.

6. The hot rolled and heat-treated steel sheet as recited in claim 1 wherein the uniform elongation is higher than 10%.

7. The hot rolled and heat-treated steel sheet as recited in claim 1 wherein the hole expansion ratio is higher than 25%.

8. The hot rolled and heat-treated steel sheet as recited in claim 1 wherein fresh martensite and martensite-austenite islands size are less than 0.7 μm.

9. The hot rolled and heat-treated steel sheet as recited in claim 1 wherein the microstructure includes the fresh martensite and the M-A islands.

10. The hot rolled and heat-treated steel sheet as recited in claim 1 wherein the M-A islands have an aspect ratio lower or equal to 2.

11. The hot rolled and heat-treated steel sheet as recited in claim 1 wherein the fresh martensite content is 2% to less than 8%.

12. The hot rolled and heat-treated steel sheet as recited in claim 1 wherein the microstructure consists of 5% to less than 10% of the M-A islands in total surface fraction.

* * * * *